US006584702B2

(12) United States Patent
Irey

(10) Patent No.: US 6,584,702 B2
(45) Date of Patent: Jul. 1, 2003

(54) DRYER VENT CONNECTION AND METHOD

(76) Inventor: Greg A. Irey, 10400 Summit Lake Rd., Olympia, WA (US) 98502

( * ) Notice: Subject to any disclaimer, the term of this patent is extended or adjusted under 35 U.S.C. 154(b) by 90 days.

(21) Appl. No.: 09/746,319

(22) Filed: Dec. 22, 2000

(65) Prior Publication Data

US 2001/0000834 A1 May 10, 2001

Related U.S. Application Data

(63) Continuation-in-part of application No. 09/395,332, filed on Sep. 13, 1999

(60) Provisional application No. 60/100,108, filed on Sep. 14, 1998.

(51) Int. Cl.[7] ..... F26B 5/04

(52) U.S. Cl. ..... 34/417; 34/87; 34/140; 34/235; 454/358

(58) Field of Search ..... 34/235, 87, 417, 34/138, 140; 454/359, 29, 903, 358; 285/9.1

(56) References Cited

U.S. PATENT DOCUMENTS 4,051,768 A * 10/1977 Bayles ..... 98/2
4,081,915 A * 4/1978 Materniak nee Babcerowicz et al. ..... 34/235
4,398,371 A * 8/1983 Jenkins ..... 49/7
5,199,190 A 4/1993 Mayer et al. ..... 34/235
5,257,468 A * 11/1993 Lebrun ..... 34/235
5,318,328 A * 6/1994 Dawson ..... 285/9.1
5,584,129 A * 12/1996 Williamson ..... 34/235
5,662,522 A 9/1997 Waltz ..... 454/359
5,722,181 A 3/1998 Meyer ..... 34/235
5,819,435 A 10/1998 Tuggle ..... 34/235

* cited by examiner

*Primary Examiner*—Pamela Wilson
(74) *Attorney, Agent, or Firm*—Delbert J. Barnard

(57) ABSTRACT

A metal plate (52) is connected to a wall (10). Plate (42) includes a vent opening (48) that communicates with vent ducting (18) with the wall (10). A magnetic sheet body (52) is connected to a vent tube (60) located at the back of a clothes dryer (64). The clothes dryer (64) is moved towards the wall (10) and the magnetic sheet body (52) is moved against the metal plate (42). A vent opening (54) in the magnetic sheet body (52) is put into alignment with the vent opening (48) in the metal plate (42). The magnetic sheet body (52) provides a seal between the two vent openings (54, 48).

16 Claims, 5 Drawing Sheets

10
12
52
64
42
32
22
58
69
30
67
18

DRYER VENT CONNECTION AND METHOD

RELATED APPLICATION

This is a continuation-in-part of applicant's U.S. Ser. No. 09/395,332, filed on Sep. 13, 1999. Priority is claimed to provisional application Ser. No. 60/100,108, filed Sep. 14, 1998.

TECHNICAL FIELD

This invention relates to a method and apparatus for connecting a vent tube on a clothes dryer to a duct system for removing water vapor from the clothes dryer. More particularly, it relates to the provision of a metal plate that includes an opening that is alignable with ducting in a wall behind the clothes dryer on which the plate is mounted, and a sheet of flexible magnetic material connected to the vent tube at the rear of the clothes dryer, and extending adjacent the back of the clothes dryer, whereby the clothes dryer can be pushed towards the wall and guided to move the magnetic sheet into coupling engagement with the metal plate on the wall.

BACKGROUND OF THE INVENTION

U.S. Pat. No. 5,318,328, granted Jun. 7, 1994, to Hugh R. Dawson sets forth a Background of The Invention which describes the difficulty of connecting the vent tube on a clothes dryer to a conduit which carries the venting water vapor away from the clothes dryer. U.S. Pat. No. 5,318,328 discloses a quick connect system which includes a ring of magnetic material that magnetically engages the vent tube on the dryer. Other known vent systems are disclosed by U.S. Pat. No. 4,081,915, granted Apr. 4, 1978, to Gizela Maternisk Rèel Babacerowicz and Zdzialaw Maternisk; U.S. Pat. No. 5,121,948, granted Jun. 16, 1992 to Charles V. Anderson and Charles R. Kenrick (re-examination Certification B1 5,121,948, issued Oct. 29, 1999); and U.S. Pat. No. 5,257,468, granted Nov. 2, 1993, to Mariel Lebrun.

The principal object of the present invention is to provide an improved quick-connect connection between the vent tube on a clothes dryer and ducting in a wall behind the clothes dryer that vents water vapor away from the clothes dryer.

It is another object of the present invention to provide a dryer vent connection that eliminates the flexible plastic or metal tubing that is normally used behind the clothes dryer and permits zero clearance installation of the clothes dryer.

BRIEF SUMMARY OF THE INVENTION

The present invention includes providing a clothes dryer vent connector and seal that is characterized by a flexible, magnetic sheet body including an opening that is surrounded by the magnetic sheet body. A first end of a length of cylindrical tubing is connected to the magnetic sheet body about the opening. The tubing includes an open second end that is spaced outwardly from the magnetic sheet body. The tubing extends substantially perpendicular to the magnetic sheet body and is sized at its second end to receive the vent tube on a clothes dryer.

An object of the present invention is to provide a connector and seal of the type described wherein the magnetic sheet body comprises magnetic material within a plastic matrix. In preferred form, the tubing is constructed from a flexible plastic material and its first end is bonded or otherwise secured to the magnetic sheet body.

The invention also includes providing a clothes dryer vent connection that includes a magnetic sheet body and connector tubing and a metal plate that is securable to a wall behind a dryer. The metal plate includes a vent opening that is surrounded by the metal plate. The metal plate is secured to a wall behind where the clothes dryer will set with its vent opening in alignment with vent ducting that is in the wall. The connector tubing is connected to a vent tube at the back of the clothes dryer. When it is so connected, the magnetic sheet body is in close proximity to the back of the clothes dryer. This allows the dryer to be moved towards the metal plate and the wall and guided as it is moved so as to move the magnetic sheet body into contact with the metal plate, and the opening in the magnetic sheet body into approximate alignment with a vent opening in the metal plate leading into vent ducting in the wall behind the clothes dryer. The clothes dryer is moved towards the wall until the magnetic sheet body becomes magnetically attached to the metal plate. This attachment provides a substantially sealed connection between the vent tube at the back of the clothes dryer and the opening into the vent ducting in the wall behind the clothes dryer.

BRIEF DESCRIPTION OF THE SEVERAL VIEWS OF THE DRAWING

Like reference numerals and letters refer to like parts throughout the several views of the drawing, and.

DETAILED DESCRIPTION OF THE INVENTION

Figure 1:
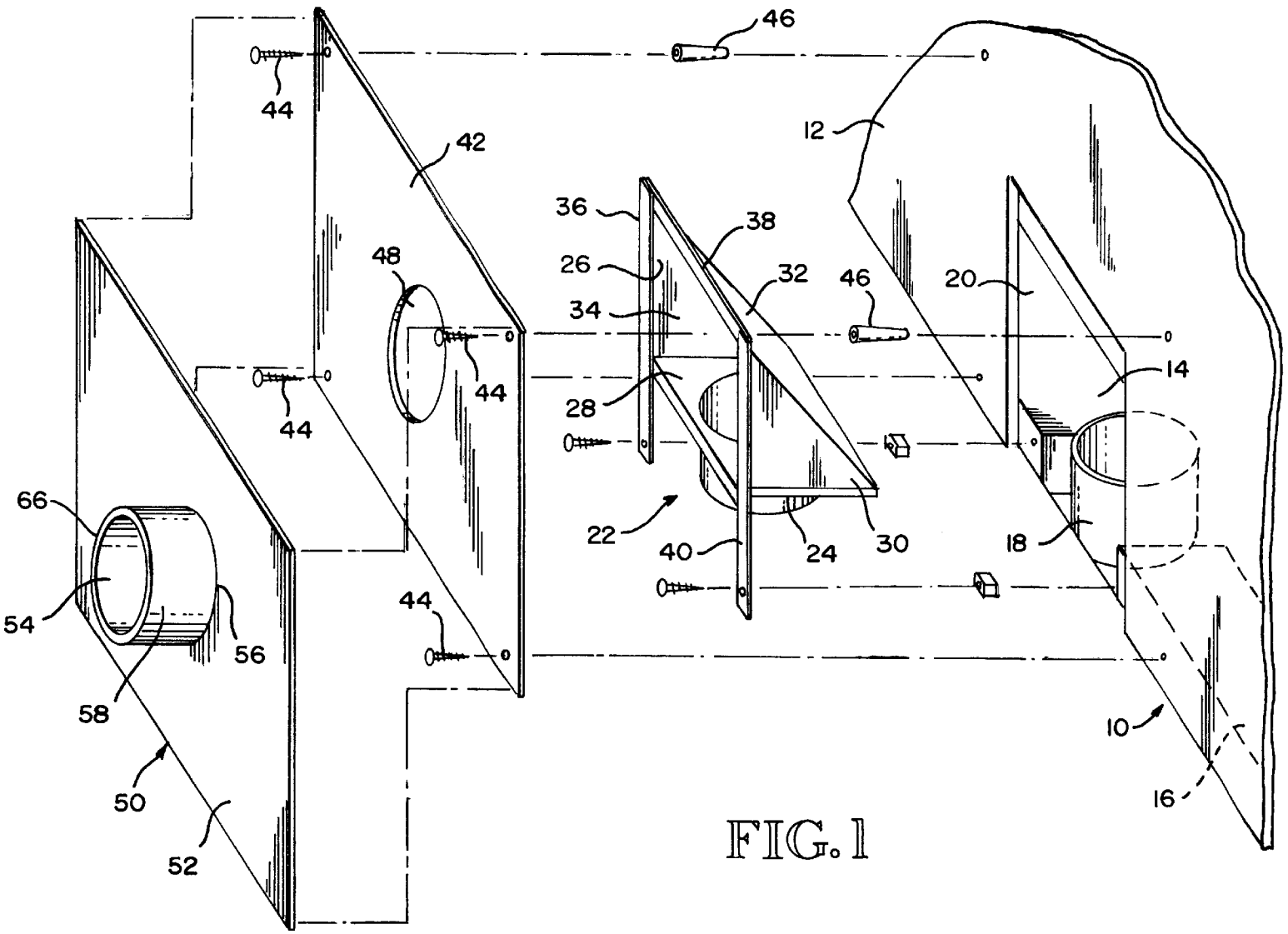
FIG. 1 is an exploded pictorial view of a fragment of a wall that includes an opening and vent ducting in the wall, a vent component that fits within the opening of the wall, a metal plate that is connected to the wall, a flexible, magnetic sheet body that is connectable to the metal plate, and a length of cylindrical tubing for connecting the magnetic sheet body to a vent duct at the back of a clothes dryer.

FIG. 1 shows a wall 10 that includes a facing panel 12 that may be constructed from wallboard. The facing panel 12 is shown connected to floor plates 14, 16 which may be two inch by four inch pieces of lumber. Space is provided between confronting ends of the plates 14, 16. The upper end of a vertically oriented vent tube 18 is positioned in this space. An opening 20 is provided in the facing material 12 forwardly of the tubing 18. By way of typical and therefore non-limitive example, a vent component 22 is insertable through the opening 20 into the wall space. It has a tubular section 24 at its lower end that either fits in or over the upper end portion of tube 18. Component 22 also includes walls 26, 28, 30, 32 that form an enclosure that is open at its front 34.

Mounting/seal strips 36, 38, 40 are provided for use in connecting the component 22 to the wall 10. When component 22 is within the wall 10, the tube 24 engages the tube 18 and the strips 36, 38, 40 are on the top and side boundaries of the opening 20. When the component 22 is installed, its opening 34 is directed outwardly. Next, a metal plate 42 is installed on the wall 10 forwardly of the opening 20. Plate 42 is larger than the opening 20. It is secured to the wall covering 12 by use of screws 44 and screw anchors 46. Metal plate 42 includes a vent opening 48 that is completely surrounded by the metal plate 42. When plate 42 is secured to the wall 10, the vent opening 48 becomes an entrance for a chamber formed in the component 22 by the walls 26, 28, 30, 32. Contact between the metal plate 42 and the strips 36, 38, 40 will substantially seal the contact of the strips 36, 38, 40 with the back side of the metal plate 42.

According to the present invention, a quick-connect connection member 50 is provided which is basically characterized by a flexible, magnetic sheet body 52 which is normally planar in shape. The magnetic sheet body 52 is provided with an opening 54 that is surrounded by the magnetic material 52. A first end 56 of a cylindrical connector tube 58 is connected to the magnetic sheet body 52 about the opening 54. The connector tube 58 is sized to fit over a vent tube 60 that is on the back side of a clothes dryer and which opens rearwardly. In standard clothes dryers the vent tube 60 is within a space 62 in a lower rear portion of the clothes dryer 64.

Figure 2:
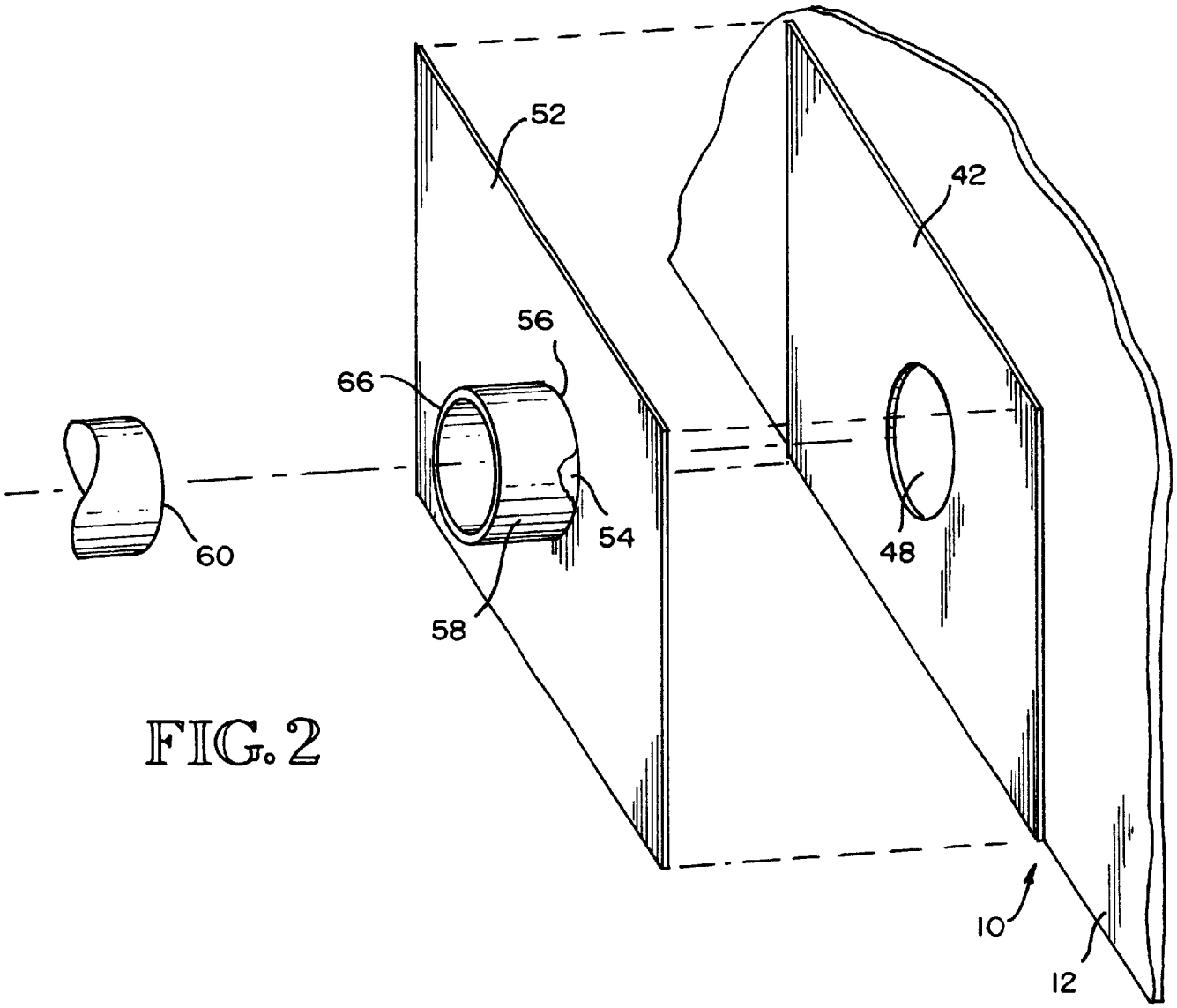
FIG. 2 is a view like FIG. 1, but with the vent fitting within the wall and concealed, and showing the metal plate attached to the wall, and showing the magnetic sheet body spaced away from the metal plate, and showing a fragment of the vent tube at the back of the clothes dryer in a space relationship with the connector table on the magnetic sheet body.
Figure 3:
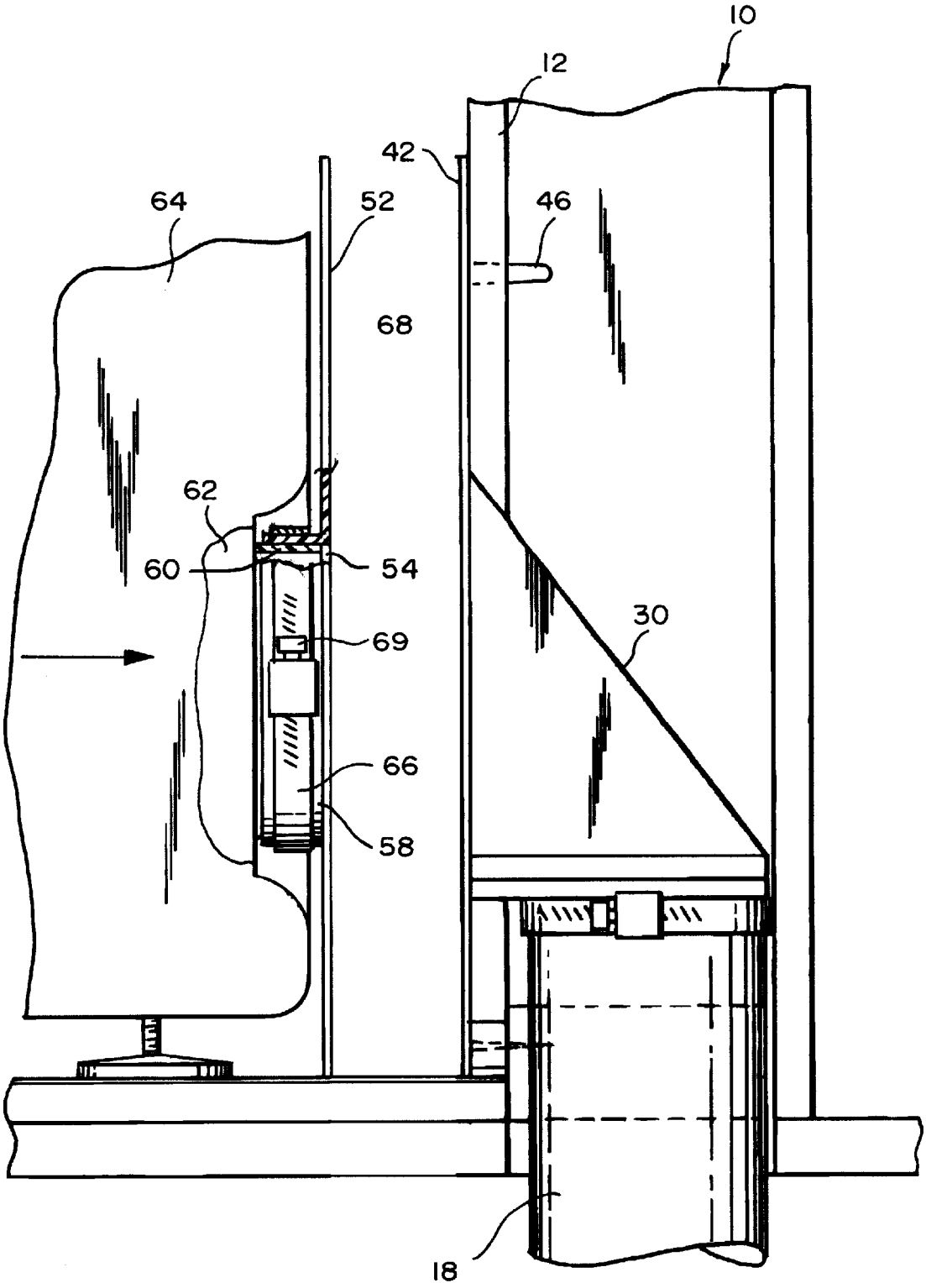
FIG. 3 is a fragmentary side elevational view, with some parts in section, showing a clothes dryer in the process of being moved towards a wall that is behind it, and showing the magnetic sheet body being moved towards the metal plate that is connected to the wall.
Figure 4:
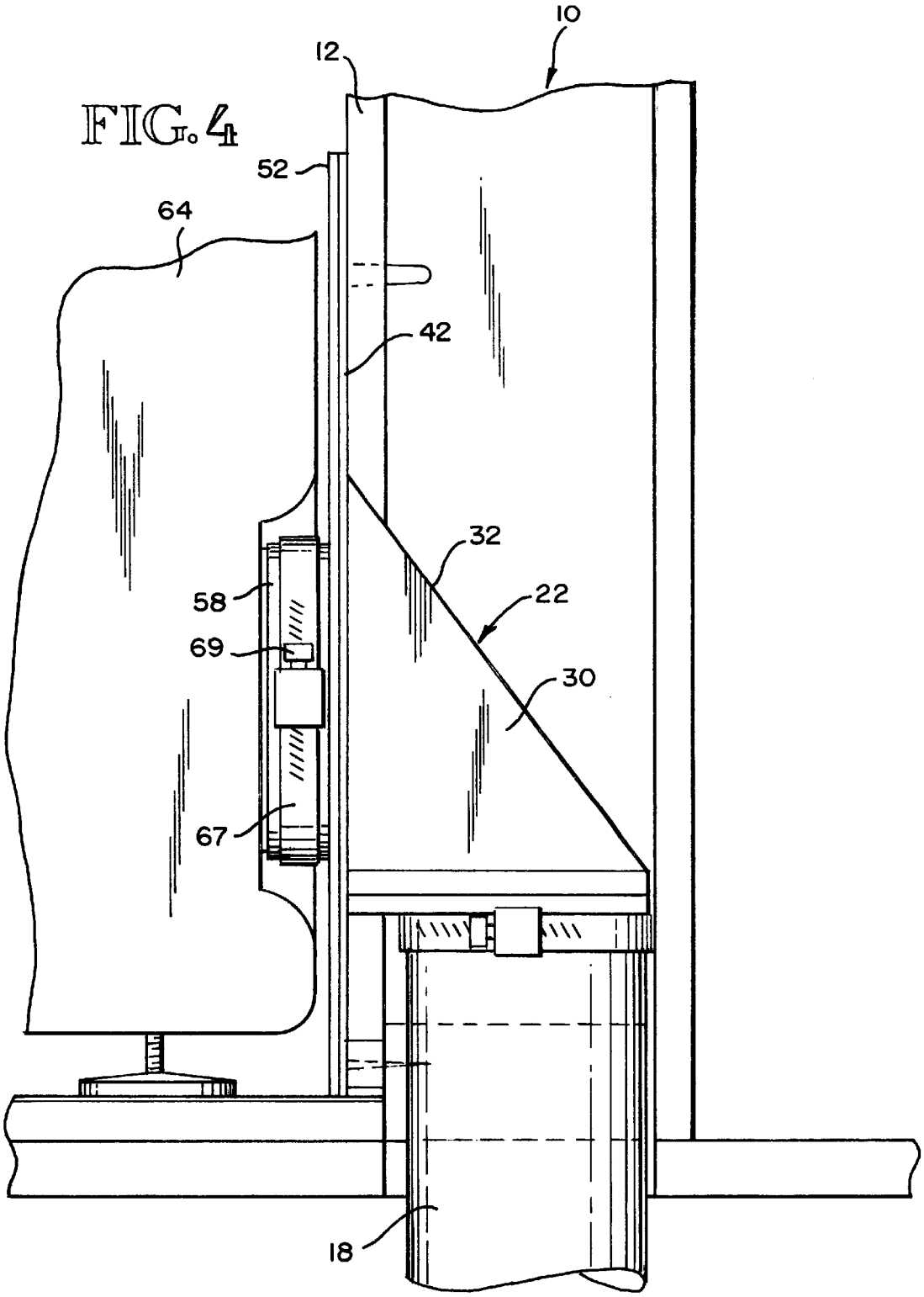
FIG. 4 is a view like FIG. 3, but showing the clothes dryer close to the wall and showing the magnetic sheet body contacting and magnetically attached to the metal plate.

Preferably, the connector tube 58 is made from a flexible plastic material, e.g. silicone. Its first end 56 is bonded or otherwise secured to the magnetic sheet body 52 generally at the periphery of the opening 54. The connection of the first end 56 to the body 52 is a sealed connection. The connector tube 58 may be longer than necessary, at least for most dryers. The installer may shorten the connector tube 58 by cutting of an end portion of it at its second end 66. Whether or not trimming is necessary, the connector tube 58 is slid over the vent tube 60. Typically, a clamp ring 67 (FIG. 4) is inserted over the connector tube 58 and then the connector tube 58 and the clamp ring 66 are together slipped over the vent tube 60. The magnetic sheet body 52 is moved forward to place it closely adjacent the back side 68 of the clothes dryer 64 (FIG. 3). Then, the magnetic sheet body 52 is bent forwardly in the vicinity of the clamp screw 70, so as to expose the clamp screw 69. Once exposed, the clamp screw 69 is rotated in a tightening direction until it securely clamps the connector tube 58 onto the vent tube 60. Then, the magnetic sheet body 52 is released so as to allow it to resume its normal shape (FIGS. 1–3).

After connector 50 is installed on the clothes dryer 64, the dryer 64 is pushed rearwardly towards the wall 10. At the same time, it is guided in order to place the opening 54 in the magnetic sheet body 52 into general alignment with the vent opening 48 in the metal plate 42. The clothes dryer 64 is pushed rearwardly until the magnetic sheet body 52 contacts and becomes magnetically attached to the metal plate 42. This attachment provides a seal between the opening 54 and the opening 48. Whenever it is desired or necessary to pull the clothes dryer 64 away from the wall 10, it is only necessary for one to grasp the clothes dryer 64 and pull on it. The magnetic sheet body 52 is easily pulled away from the metal plate 42.

Figure 6:
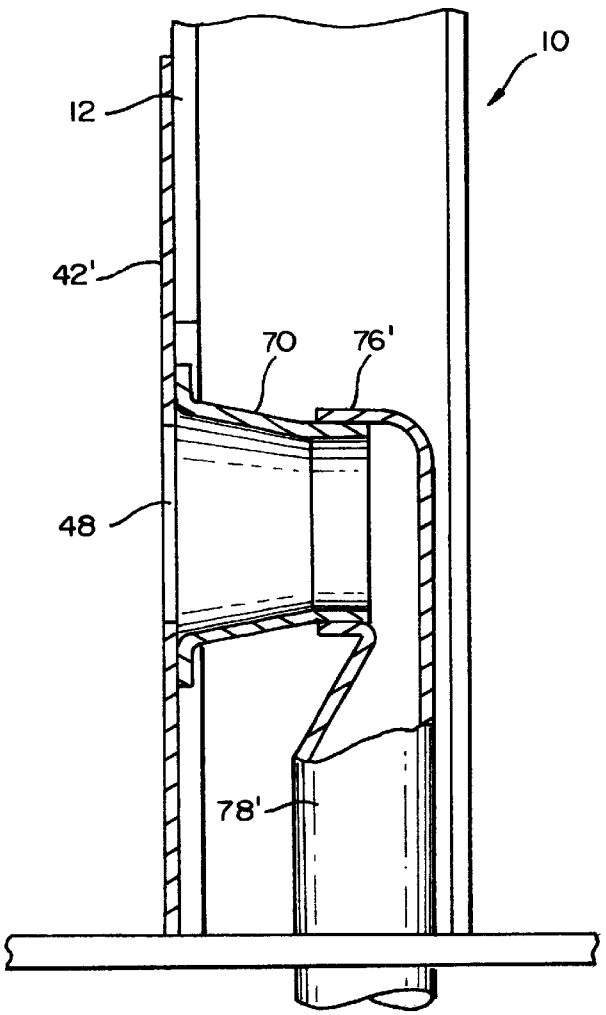
FIG. 6 is a view like FIG. 5, but showing vent tubing extending vertically in the wall.
Figure 5:
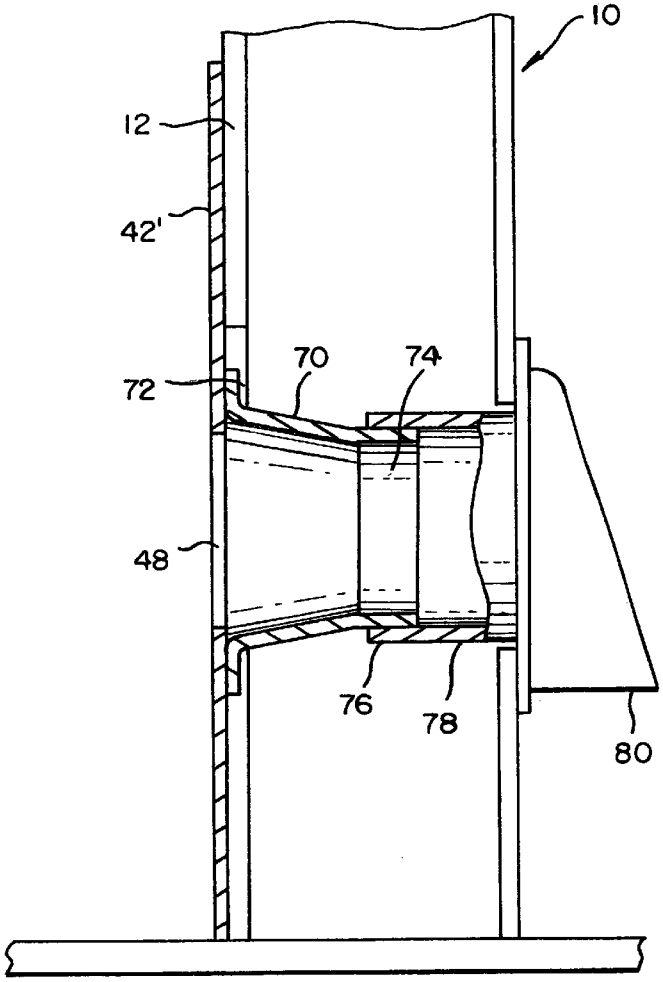
FIG. 5 is a schematic view of a modified form of the metal plate spaced from vent tubing in the wall that extends horizontally through the wall.

FIG. 5 shows a modified construction of the metal plate 42'. Plate 42' includes a duct section 70 that is connected at its forward end 72 to the metal plate 42' about the vent opening 48. The rear end of tube 70 includes a nipple 74 that is sized to make telescopic engagement with an end portion 76, 76' of vent ducting 78, 78'. FIG. 5 shows vent ducting 78 that extends horizontally through the wall 10 to an outlet 80 that is outside the wall. FIG. 6 shows vent ducting 78' that extends vertically. The lower end of the vertical duct may be connected to other ducting that extends horizontally. The particular pattern of vent ducting within the wall is not material to the invention and can be any pattern that has been used or in the future will be used. The construction of the metal plate 42' can also vary substantially. The important feature is that the plate 42' includes a member that is in some way connected to it which is adapted to be connected to an end portion of some sort of vent ducting that is within the wall 10.

The dryer vent connection of the present invention permits a clothes dryer to be quickly connected to vent ducting and quickly disconnected from the vent ducting when necessary. The connection allows for zero clearance of the dryer to the wall. This is particularly important in installations which include adjacent cabinet drawer and/or door openings. The system is substantially self-aligning. It allows repeated connection and disconnection without any loss in reliability. When the magnetic member comes near to the metal plate, the magnetic properties bring and hold the two together and provide a seal that is superior to most conventional mechanical conventions. The flexibility of the connector tube will allow the magnetic sheet to absorb normal dryer vibrations without disrupting the seal function. The flexibility of the magnetic sheet allows it to be bent to provide access to the clamp screw.

The flexible magnetic sheet material is a readily available material that includes magnetic particles within a rubber or rubber like matrix. One popular use is for flexible refrigerator door magnets.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A clothes dryer vent connector and seal, comprising:

a flexible, magnetic sheet body including an opening that is surrounded by the magnetic sheet body; and a length of cylindrical tubing having a first end that is connected to the magnetic sheet body about said opening and an open second end that is spaced outwardly from said magnetic sheet body, said length of tubing extending substantially perpendicular to the magnetic sheet body, and being sized at its second end to engage a vent tube on a clothes dryer.

2. The clothes dryer vent connector and seal of claim 1, wherein the magnetic sheet body comprises magnetic material within a plastic matrix.

3. The clothes dryer vent connector and seal of claim 1, wherein the length of cylindrical tubing is constructed from a flexible plastic material.

4. The clothes dryer vent connector and seal of claim 3, wherein the magnetic sheet body comprises magnetic material within a plastic matrix.

5. The clothes dryer vent connector and seal of claim 1, wherein the magnetic sheet body is sufficiently bendable so that where installed it can be bent to provide access to the length of cylindrical tubing forwardly of the magnetic sheet body.

6. A clothes dryer vent connection, comprising:

a metal plate securable to a wall behind a dryer, said plate including an opening that is surrounded by the metal plate;

a flexible, magnetic sheet body including an opening that is surrounded by the magnetic sheet body; and a length of cylindrical tubing having a first end that is connected to the magnetic sheet body about said opening in said magnetic sheet body, and an open second end that is spaced outwardly from said magnetic sheet body, said tubing extending substantially perpendicular to the magnetic sheet body, and being sized at its second end to engage a vent tube on a clothes dryer and place the magnetic sheet body closely adjacent the rear of the clothes dryer, whereby the clothes dryer can be pushed towards the wall so as to move the magnetic sheet body into sealing contact with the metal plate on the wall and move the opening in the magnetic sheet body into alignment with the opening in the metal plate.

7. The clothes dryer vent connection of claim 6, wherein the magnetic sheet body comprises magnetic material within a plastic matrix.

8. The clothes dryer vent connection of claim 7, wherein the length of cylindrical tubing is constructed from a flexible plastic.

9. The clothes dryer vent connection according to claim 8, wherein the magnetic sheet body comprises magnetic material within a rubber matrix.

10. The clothes dryer vent connection of claim 6, wherein the magnetic sheet body is sufficiently bendable so that when the length of cylindrical tubing is installed on a clothes dryer vent tube the magnetic sheet body can be bent to provide access to the length of cylindrical tubing.

11. The clothes dryer vent connection of claim 6, wherein the metal plate includes a duct section extending from it away from said magnetic sheet body.

12. A method of connecting a vent tube at the back of a clothes dryer to vent ducting in a wall behind the clothes dryer, comprising:

providing a metal plate that includes a vent opening that is surrounded by the metal plate;

securing the metal plate to the wall with the vent opening in the metal plate in alignment with the vent ducting in the wall;

providing a flexible, magnetic sheet body including a vent opening that is surrounded by the magnetic sheet body, and a length of cylindrical tubing having a first end that is connected to the magnetic sheet body about said vent opening in the body and an open second end that is spaced from and extends substantially perpendicular to the magnetic sheet body;

positioning the length of cylindrical tubing on the vent tube of the clothes dryer with its second end directed towards the clothes dryer;

moving the length of cylindrical tubing and the flexible, magnetic sheet body towards the dryer until the cylindrical tubing is on the vent tube and the flexible, magnetic sheet body is closely adjacent the back of the dryer; and moving the clothes dryer towards the metal plate and the wall, and guiding it to move the flexible, magnetic sheet body into contact with the metal plate, whereby magnetic attraction will secure the flexible, magnetic sheet body to the metal plate and provide a substantially sealed connection between the vent tube at the back of the clothes dryer and the opening into the vent ducting in the wall behind the clothes dryer.

13. The method of claim 12, comprising making the length of cylindrical tubing from a flexible plastic material and slipping said length of tubing over the vent tube at the back of the clothes dryer.

14. The method of claim 13, comprising securing the length of tubing to the vent tube of the clothes dryer by use of a hose clamp that surrounds both the length of tubing and the vent tube.

15. The method of claim 14, comprising bending the flexible, magnetic sheet body away from the dryer to provide access to the clamp, and then tightening the clamp so as to clamp the length of tubing onto the vent tube.

16. The method of claim 12, comprising providing a sealed connection between the first end of the length of tubing and the flexible, magnetic sheet body.

* * * * *